US011024249B2

(12) United States Patent
Kim et al.

(10) Patent No.: US 11,024,249 B2
(45) Date of Patent: Jun. 1, 2021

(54) DISPLAY DEVICE AND DRIVING METHOD THEREOF

(71) Applicant: SAMSUNG DISPLAY CO., LTD., Yongin-si (KR)

(72) Inventors: Hoe Mi Kim, Yongin-si (KR); Ki Hyun Pyun, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/795,791

(22) Filed: Feb. 20, 2020

(65) Prior Publication Data

US 2020/0312260 A1 Oct. 1, 2020

(30) Foreign Application Priority Data

Mar. 27, 2019 (KR) ..... 10-2019-0035365

(51) Int. Cl.
*G09G 3/36* (2006.01)
*G09G 5/00* (2006.01)

(52) U.S. Cl.
CPC ..... *G09G 3/3688* (2013.01); *G09G 3/3677* (2013.01); *G09G 3/3696* (2013.01); *G09G 5/008* (2013.01); *G09G 2310/0264* (2013.01); *G09G 2310/08* (2013.01); *G09G 2320/0693* (2013.01); *G09G 2370/08* (2013.01)

(58) Field of Classification Search
CPC .... G09G 3/3685; G09G 3/2096; G09G 5/008; G09G 3/3614; G09G 2370/08; G09G 2370/14; G09G 3/3611; G09G 1/285; G09G 3/3688; G09G 3/3677; G09G 3/3696; G09G 2310/0264; G09G 2320/0693; G09G 2310/08; G09G 2310/027; G09G 3/3208; G09G 3/3291; G09G 3/3258; G06F 3/147; G06F 3/153
See application file for complete search history.

(56) References Cited

U.S. PATENT DOCUMENTS 5,796,392 A * 8/1998 Eglit ..... G09G 5/008 345/213
6,037,925 A * 3/2000 Kim ..... G09G 3/3611 345/99
RE38,618 E * 10/2004 West ..... G09G 3/20 348/536
8,638,843 B2 * 1/2014 Yamaguchi ..... H04B 3/12 375/232

(Continued)

FOREIGN PATENT DOCUMENTS

JP 5700546 B2 2/2015
KR 100633780 B1 10/2006
KR 1020130043559 A 4/2013

*Primary Examiner* — Michael J Jansen, II
(74) *Attorney, Agent, or Firm* — Cantor Colburn LLP

(57) ABSTRACT

A source driver includes an equalizer which outputs compensated image data by adjusting a frequency gain of image data, based on a selected option value among a plurality of option values. A recovery recovers a clock signal corresponding to the compensated image data. A calibrator sequentially provides the plurality of option values to the equalizer, and selects the selected option value among the plurality of option values, based on recovery rates of the clock signal, which respectively correspond to the plurality of option values.

13 Claims, 6 Drawing Sheets

(56) References Cited

U.S. PATENT DOCUMENTS

| | | | | |
|---|---|---|---|---|
| 8,878,792 | B2 * | 11/2014 | Lim | H03L 7/0816 345/173 |
| 9,288,087 | B2 * | 3/2016 | Shin | H04L 25/03057 |
| 9,589,524 | B2 * | 3/2017 | Park | G09G 5/008 |
| 9,818,329 | B2 * | 11/2017 | Park | G09G 3/3688 |
| 9,875,714 | B2 * | 1/2018 | Lee | G09G 3/3688 |
| 10,163,386 | B2 * | 12/2018 | Lee | G09G 3/2096 |
| 10,169,713 | B2 * | 1/2019 | Blanco | G06Q 50/01 |
| 10,699,618 | B2 * | 6/2020 | Huang | G09G 5/008 |
| 2006/0023779 | A1 * | 2/2006 | Kwak | H04L 25/03885 375/229 |
| 2011/0037758 | A1 * | 2/2011 | Lim | H03L 7/0805 345/213 |
| 2013/0014199 | A1 * | 1/2013 | Horan | H04N 5/775 725/127 |
| 2015/0187315 | A1 * | 7/2015 | Park | G09G 3/3685 345/99 |
| 2017/0069257 | A1 * | 3/2017 | Lee | G09G 5/005 |
| 2017/0132966 | A1 * | 5/2017 | Lim | G09G 3/2092 |
| 2018/0262380 | A1 * | 9/2018 | Yeste Ojeda | H04L 25/0307 |
| 2019/0340968 | A1 * | 11/2019 | Huang | G09G 3/20 |
| 2019/0341000 | A1 * | 11/2019 | Tseng | G09G 5/008 |
| 2020/0098330 | A1 * | 3/2020 | Pyun | G06F 1/10 |
| 2020/0145181 | A1 * | 5/2020 | Kim | H04L 7/044 |
| 2020/0193884 | A1 * | 6/2020 | Kim | G09G 5/008 |
| 2020/0265766 | A1 * | 8/2020 | Huang | G09G 5/008 |
| 2020/0304348 | A1 * | 9/2020 | Zerbe | H04L 25/03057 |
| 2020/0312260 | A1 * | 10/2020 | Kim | G09G 3/3677 |

* cited by examiner

DISPLAY DEVICE AND DRIVING METHOD THEREOF

This application claims priority to Korean patent application 10-2019-0035365 filed on Mar. 27, 2019, and all the benefits accruing therefrom under 35 U.S.C. § 119, the content of which in its entirety is herein incorporated by reference.

BACKGROUND

1. Field

Exemplary embodiments of the invention generally relate to a display device and a driving method thereof.

2. Description of the Related Art

A display device such as a liquid crystal display device or an organic light emitting display device transmits various types of data necessary for generation of a data signal through an intra-panel interface established between a timing controller and a source driver (or source drive integrated circuit ("IC")).

When a data rate of the intra-panel interface is increased, a signal distortion (or signal loss) becomes serious, and a signal integrity of frame data is deteriorated. Therefore, the source driver may be provided with a recovery circuit (e.g., an equalizer) which recovers a distorted signal in a transmission process.

The data rate or a transmission line, etc., of the intra-panel interface varies depending on display devices, and therefore, an external setting pin for allowing a user to set an equalizer suitable for a corresponding display device may be provided to the equalizer.

SUMMARY

A size of a source driver (or printed circuit board ("PCB")) is increased by an external setting pin, and a manufacturing efficiency of a display device is low due to a setting operation of a user through the external setting pin.

Exemplary embodiments provide a source driver capable of reducing manufacturing cost by automatically setting an equalizer and a display device including the source driver.

An exemplary embodiment of the invention provides a source driver including a receiver which receives image data, and a data signal generator which generates and outputs a data voltage, based on the image data, where the receiver includes an equalizer which outputs compensated image data by adjusting a frequency gain of the image data, based on a selected option value among a plurality of option values in a first period, a recovery which recovers a clock signal corresponding to the compensated image data, and a calibrator which sequentially provides the plurality of option values to the equalizer in a second period prior to the first period, and selects the selected option value among the plurality of option values, based on recovery rates of the clock signal, which respectively correspond to the plurality of option values.

In an exemplary embodiment, the recovery may include a phase detector which detects a phase difference between the compensated image data and the clock signal, a charge pump which generates a voltage control signal by converting the detected phase difference into a voltage signal, and a voltage control oscillator which outputs the clock signal in response to the voltage control signal. The calibrator may compare change rates of the voltage control signal, which respectively correspond to the plurality of option values. The selected option value may correspond to a greatest change rate among the change rates of the voltage control signal.

In an exemplary embodiment, the calibrator may include a differentiator which outputs a differential value by differentiating the voltage control signal, and a controller which selects the selected option value among the plurality of option values, based on the differential value.

In an exemplary embodiment, the controller may include a storage circuit which stores differential values respectively corresponding to the plurality of option values, and a comparison circuit which outputs a maximum differential value greatest among the differential values by comparing the differential values.

In an exemplary embodiment, the storage circuit may include sub-storage circuits which respectively store the differential values. Each of the sub-storage circuits may include a switching element and a storage element, which are connected in series between an output terminal of the differentiator and an input terminal of the comparison circuit. The switching element may be turned on in response to a corresponding option value.

In an exemplary embodiment, the calibrator may further include a lock detector which determines whether a frequency of the compensated image data corresponds to that of the clock signal. The controller may operate based on an output signal of the lock detector.

In an exemplary embodiment, the calibrator may further include an enable signal generator which generates an enable signal during a predetermined period, based on a power voltage applied from an outside. The enable signal may be applied to the controller in the second period.

In an exemplary embodiment, the controller may generate a reset signal in a pulse form at a time when a reference time elapses from a time when the output signal of the lock detector is changed from a logic low level to a logic high level. The voltage control oscillator may be reset based on the reset signal.

In an exemplary embodiment, when the voltage control oscillator is reset, the voltage control signal may have a minimum control voltage. The voltage control signal may be linearly changed up to a target control voltage according to an operation of the voltage control oscillator.

In accordance with another exemplary embodiment of the invention, there is provided a display device including a timing controller which generates image data, a data driver which generates a data voltage, based on the image data, and a display unit including a pixel which receives the data voltage through a data line and emits light with a luminance corresponding to the data voltage, where the data driver includes an equalizer which receives the image data, and output compensated image data by adjusting a frequency gain of the image data, based on a selected option value among a plurality of option values in a first period, a recovery which recovers a clock signal corresponding to the compensated image data, and a calibrator which sequentially provides the plurality of option values to the equalizer in a second period prior to the first period, and select the selected option value among the plurality of option values, based on recovery rates of the clock signal, which respectively correspond to the plurality of option values.

In an exemplary embodiment, the recovery may include a phase detector which detects a phase difference between the compensated image data and the clock signal, a charge pump which generates a voltage control signal by converting the detected phase difference into a voltage signal, and a voltage control oscillator which outputs the clock signal in response to the voltage control signal. The calibrator may compare change rates of the voltage control signal, which respectively correspond to the plurality of option values. The selected option value may correspond a greatest change rate among the change rates of the voltage control signal.

In an exemplary embodiment, the calibrator may include a differentiator which outputs a differential value by differentiating the voltage control signal, and a controller which selects an option value among the plurality of option values, based on the differential value.

In an exemplary embodiment, the controller may include a storage circuit which stores differential values respectively corresponding to the plurality of option values, and a comparison circuit which outputs a maximum differential value greatest among the differential values by comparing the differential values.

In an exemplary embodiment, the calibrator may further include a lock detector which determines whether a frequency of the compensated image data corresponds to that of the clock signal. The controller may operate based on an output signal of the lock detector.

In an exemplary embodiment, the controller may generate a reset signal in a pulse form at a time when a reference time elapses from a time when the output signal of the lock detector is changed from a logic low level to a logic high level. The voltage control oscillator may be reset based on the reset signal.

BRIEF DESCRIPTION OF THE DRAWINGS

Exemplary embodiments will now be described more fully hereinafter with reference to the accompanying drawings, however, they may be embodied in different forms and should not be construed as limited to the exemplary embodiments set forth herein. Rather, these embodiments are provided so that the invention will be thorough and complete, and will fully convey the scope of the exemplary embodiments to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
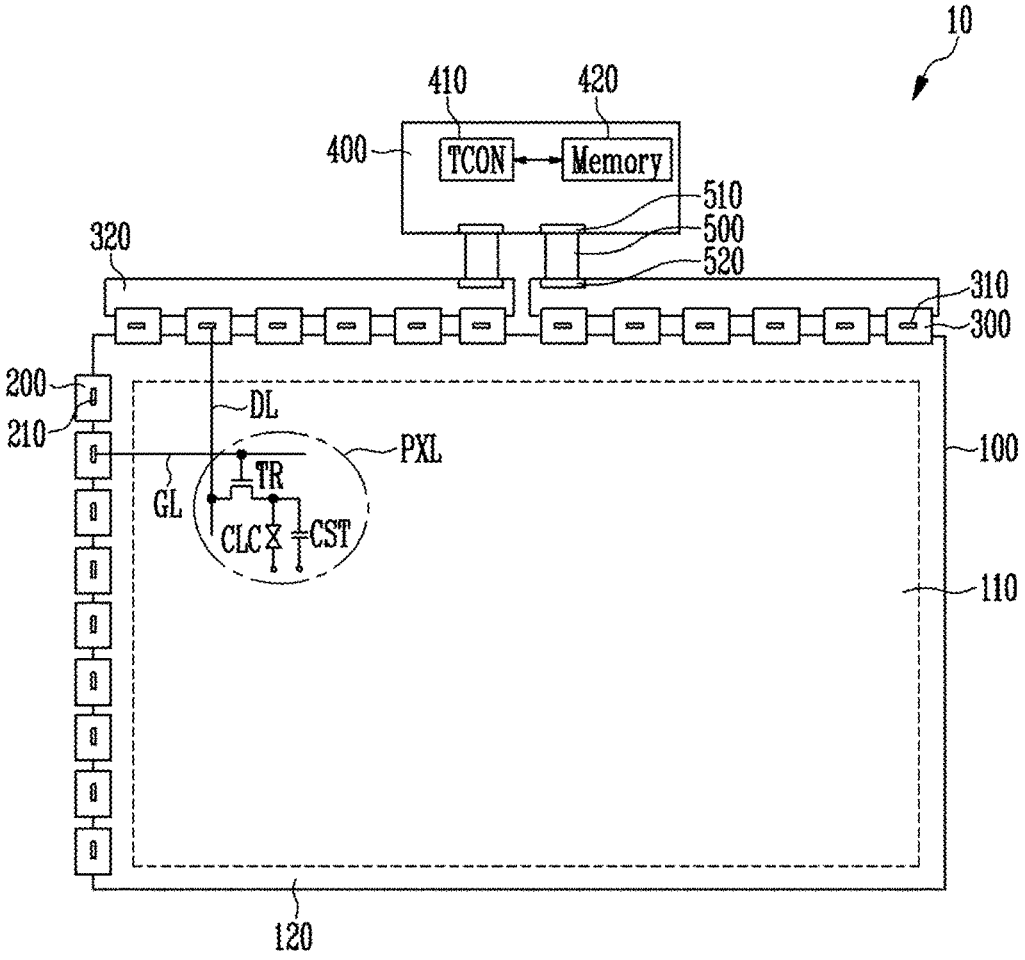
FIG. 1 is a diagram illustrating an exemplary embodiment of a display device in accordance with the invention.

Hereinafter, exemplary embodiments are described in detail with reference to the accompanying drawings so that those skilled in the art may easily practice the invention. The invention may be implemented in various different forms and is not limited to the exemplary embodiments described in the specification.

A part irrelevant to the description will be omitted to clearly describe the invention, and the same or similar constituent elements will be designated by the same reference numerals throughout the specification. Therefore, the same reference numerals may be used in different drawings to identify the same or similar elements.

In addition, the size and thickness of each component illustrated in the drawings are arbitrarily shown for better understanding and ease of description, but the invention is not limited thereto. Thicknesses of several portions and regions are exaggerated for clear expressions.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a diagram illustrating an exemplary embodiment of a display device in accordance with the invention. In FIG. 1, a liquid crystal display device including a plurality of gate drive integrated circuits ("ICs") and a plurality of source drive ICs is illustrated as one of embodiments to which the invention is applied. However, the invention is not limited thereto. In an exemplary embodiment, the invention may be applied to a display device including one gate drive IC and on source drive IC, for example. In addition, the invention is not limited to the liquid crystal display device, and may be applied to other types of display devices such as an organic light emitting display device.

Referring to FIG. 1, the display device 10 includes a display panel 100, a gate drive IC (or gate driver) 210, a source drive IC (source driver, data driver, or driving IC) 310, and a timing controller ("TCON") 410. Also, the display device 10 may further include a memory device 420 and a cable 500.

The display panel 100 may include a display area 110 in which an image is displayed and a non-display area 120 at the periphery of the display area 110. The display panel 100 may include a gate line GL, a data line DL, and a pixel PXL. The pixel PXL may be located in an area defined by the gate line GL and the data line DL.

The pixel PXL may include a switching element TR, a liquid crystal capacitor CLC, and a storage capacitor CST. The switching element TR may be electrically connected to the gate line GL and the data line DL in the area in which the pixel PXL is disposed. The liquid crystal capacitor CLC may be connected to the switching element TR, and the storage capacitor CST may be connected to the liquid crystal capacitor CLC. The pixel PXL may receive a data signal through the data line DL in response to a gate signal provided through the gate line GL. The pixel PXL stores the data signal in the storage capacitor CST, and controls an emission amount of light supplied from a backlight (not shown), corresponding to the data signal, thereby displaying a luminance corresponding to the data signal.

The TCON 410 may control the gate drive IC 210 and the source drive IC 310. The TCON 410 may receive a control signal (e.g., a control signal including a clock signal) from the outside, and generate a gate control signal and a data control signal in response to the control signal. The TCON 410 may provide the gate control signal to the gate drive IC 210, and provide the data control signal to the source drive IC 310.

Also, the TCON 410 may generate frame data (or image data) by realigning input data (or original image data) provided from the outside (e.g., a graphic processor), and provide the frame data to the source drive IC 310. The TCON 410 may transmit the frame data in a packet form to the source drive IC 310 by a serial interface (or high-speed serial interface). The TCON 410 may be disposed (e.g., mounted) on a control board 400.

The gate drive IC 210 and the source drive IC 310 may drive the display panel 100.

The gate drive IC 210 may be supplied with a gate control signal from the TCON 410, and generate gate signals in response to the gate control signal. The gate drive IC 210 may provide a gate signal to the gate line GL.

The gate drive IC 210 may be disposed (e.g., mounted) on a gate drive circuit film 200, and be connected to the TCON 410 disposed (e.g., mounted) on the control board 400 via at least one source drive circuit film 300, a source printed circuit board 320, and/or the cable (or flexible printed circuit board) 500. However, the invention is not limited thereto. In an exemplary embodiment, the gate drive IC 210 may be provided together with the pixel PXL on the display panel 100, for example.

The source drive IC 310 may be supplied with a data control signal and frame data from the TCON 410, and generate a data signal corresponding to the frame data. The data signal of the source drive IC 310 may be provided to the data line DL. The source drive IC 310 may be disposed (e.g., mounted) on the source drive circuit film 300, and be connected to the TCON 410 via at least one source printed circuit board 320 and/or the cable 500.

In some exemplary embodiments, the source drive IC 310 compensates for distortion of the frame data, and may adjust or change a signal compensation capability, based on a transmission rate of the frame data. The signal compensation capability is a capability of recovering distorted frame data, and may include, for example, a compensation gain of a high-frequency component.

In an exemplary embodiment, when the transmission rate (or frame frequency) of the frame data is relatively high, the source drive IC 310 may relatively increase the signal compensation capability (e.g., the compensation gain of the high-frequency component). In another exemplary embodiment, when the transmission rate (or frame frequency) of the frame data is relatively low, the source drive IC 310 may relatively decrease the signal compensation capability.

A detailed configuration and operation of the source drive IC will be described later with reference to FIG. 3.

The memory device 420 may be disposed (e.g., mounted) on the control board 400. In an exemplary embodiment, the memory device 420 may be a nonvolatile memory ("NVRAM"). The memory device 420 may store data necessary for an operation of the TCON 410 (e.g., a driving setting value of the display device 10, a grayscale compensation value for luminance compensation for each pixel, etc.).

The cable 500 may electrically connect the control board 400 and at least one source printed circuit board 320 through upper and lower connectors 510 and 520. The cable 500 inclusively means a device including a line capable of electrically connecting the control board 400, the source printed circuit board 320, etc. In an exemplary embodiment, the cable 500 may be implemented with a flexible circuit board, for example.

As described with reference to FIG. 1, the display device 10 may change the signal compensation capability (i.e., recovery capability with respect to distortion of frame data) of the source drive IC 310, corresponding to the transmission rate of the frame data.

Figure 2:
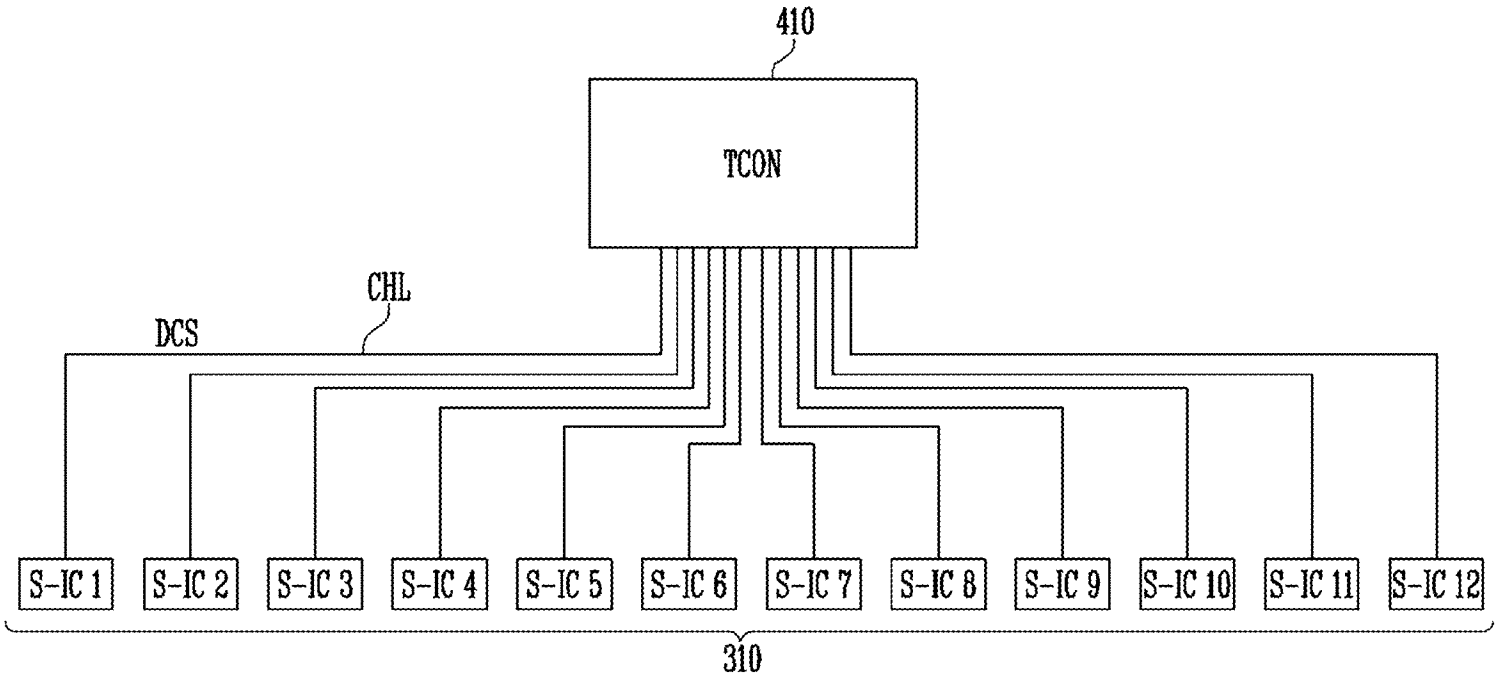
FIG. 2 is a diagram illustrating an exemplary embodiment of a signal transmission line connecting a timing controller and a source drive integrated circuit ("IC"), which are included in the display device shown in FIG. 1.

FIG. 2 is a diagram illustrating an exemplary embodiment of a signal transmission line connecting the TCON and the source drive IC, which are included in the display device shown in FIG. 1.

In FIG. 2, twelve source drive ICs, i.e., first to twelfth source drive ICs S-IC 1 to S-IC 12 are illustrated. The first to twelfth source drive ICs S-IC 1 to S-IC 12 may be substantially identically configured. Each of the first to twelfth source drive ICs S-IC 1 to S-IC 12 may be connected to a data line of an allocated area among data lines disposed in the display panel 100, to provide a data signal to the corresponding data line.

Referring to FIG. 2, a channel line CHL is disposed between the source drive IC 310 and the TCON 410. The channel line CHL may be included in the signal transmission line described with reference to FIG. 1.

The channel line CHL may be disposed between each source drive IC 310 and the TCON 410. Although a case where one channel line CHL is disposed between each source drive IC 310 and the TCON 410 is illustrated in FIG. 2, the invention is not limited thereto. In an exemplary embodiment, a pair of channel lines CHL may be disposed between each source drive IC 310 and the TCON 410, or the number of lines constituting the channel line CHL may be variously changed, for example.

The channel line CHL may be used to transmit a data control signal DCS necessary for driving of the source drive IC 310 and frame data from the TCON 410 to each source drive IC 310.

Figure 3:
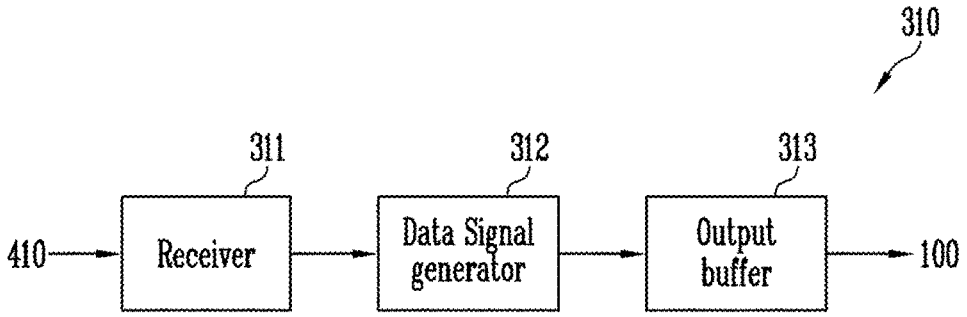
FIG. 3 is a block diagram illustrating an exemplary embodiment of the source drive IC shown in FIG. 2.

FIG. 3 is a block diagram illustrating an exemplary embodiment of the source drive IC shown in FIG. 2.

Referring to FIG. 3, the source drive IC 310 may include a receiver 311, a data signal generator (or data voltage generator) 312, and an output unit (or output buffer) 313.

The receiver 311 may receive frame data from the TCON 410, and transfer the frame data to the data signal generator 312. The frame data may be configured in the form of a packet including a clock training pattern, etc. In an exemplary embodiment, the receiver 311 may rearrange and output in parallel frame data (or packet data) serially transmitted from the TCON 410 through one signal transmission line (or a pair of signal transmission lines), corresponding to data lines, for example.

In some exemplary embodiments, the receiver 311 may compensate for distortion of frame data, which is caused by the signal transmission line. The receiver 311 may recover (or generate) a clock signal corresponding to a transmission rate of the frame data, and adaptively change a capability of compensating form the distortion of the frame data (e.g., a gain for each frequency), based on a recovery rate of the clock signal. A more detailed configuration of the receiver 311 will be described later with reference to FIG. 4.

The data signal generator 312 may generate a data signal (or data voltage), based on the frame data. In an exemplary embodiment, the data signal generator 312 may include a shift register, a data latch, and a digital-to-analog converter ("DAC"), for example. The shift register may sequentially provide frame data (or parallel data) to the data latch. The data latch may latch the data sequentially received from the shift register and simultaneously provide to the DAC. The DAC may convert the digital data into an analog data signal (or data voltage), based on gamma voltages.

The output buffer 313 may select a polarity of the data signal and output the data signal having the selected polarity to the data lines. In an exemplary embodiment, the output buffer 313 may select one of a positive data voltage and a negative data voltage, which corresponds to the data signal, and output the selected data voltage to the data lines, for example.

Figure 4:
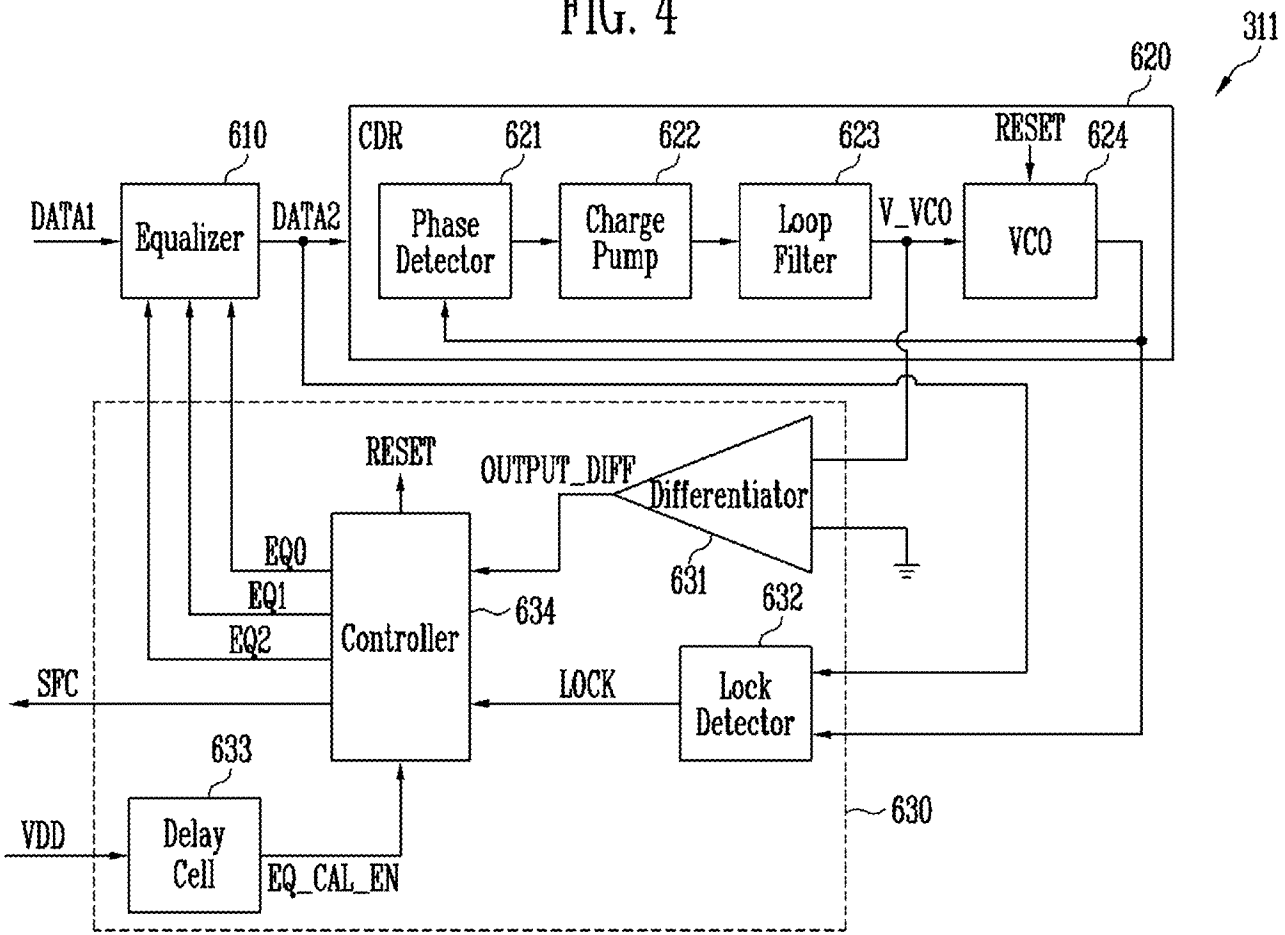
FIG. 4 is a block diagram illustrating an exemplary embodiment of a receiver included in the source drive IC shown in FIG. 3.

FIG. 4 is a block diagram illustrating an exemplary embodiment of the receiver included in the source drive IC shown in FIG. 3.

Referring to FIG. 4, the receiver 311 may include an equalizer 610, a recovery (or clock/data recovery) 620, and a calibrator (calibration controller or setter) 630.

The equalizer 610 may output compensated image data (or compensated frame data) DATA2 by adjusting a frequency gain of image data (or frame data) DATA1, based on a selected option value (optimum option value or optimum setting value) among a plurality of option values (or setting values). That is, the equalizer 610 may compensate for signal distortion (e.g., distortion of a high-frequency component) in a transmission process between the source drive ICs 310 from the TCON 410 by flattening a frequency response of the image data DATA1. The plurality of option values is preset, and frequency gains (e.g., gains with respect to a high frequency) of the equalizer 610 according to the option values may have different values.

In an exemplary embodiment, the plurality of option values may be determined by combinations of first to third setting values EQ0, EQ1, and EQ2. In an exemplary embodiment, when each of the first to third setting values EQ0, EQ1, and EQ2 has a value of one bit (e.g., a value of 0 or 1), eight option values may be set, for example. However, this is merely illustrative, and the option values are not limited thereto. In an exemplary embodiment, option values of 2 bits, 3 bits, 5 bits or more may be set, for example.

The equalizer 610 may be implemented with a general equalizer, and therefore, a description of a detailed configuration of the equalizer 610 will be omitted.

Although not shown in FIG. 4, the receiver 311 may further include an input buffer (e.g., a differential amplifier type input buffer) disposed at a front end or rear end of the equalizer 610 to remove a noise (or noise signal) included in the image data DATA1 or the compensated image data DATA2.

The recovery 620 may recover a clock signal and image data by the compensated image data DATA2 (or a signal equalized by the equalizer 610). In an exemplary embodiment, the recovery 620 may generate a clock signal (e.g., a clock signal having a frequency of 1 gigahertz (GHz)) corresponding to a transmission rate (e.g., 2 gigabits per second (Gbps)) of the image data DATA1, and recover image data, based on the clock signal, for example.

The recovery 620 may include a phase detector 621, a charge pump 622, a loop filter 623, and a voltage control oscillator ("VCO") 624.

The phase detector 621 may detect a phase difference by comparing image data (e.g., a clock training pattern included in the image data) and a fed-back clock signal (i.e., a clock signal generated in the VCO 624). In an exemplary embodiment, the phase detector 621 may output a pulse signal corresponding to the phase difference, for example.

The charge pump 622 and the loop filter 623 may generate a voltage control signal V_VCO by converting the phase difference detected by the phase detector 621 into a voltage signal. In an exemplary embodiment, the charge pump 622 may convert a pulse signal into a voltage or output a voltage in proportion to the pulse signal. The loop filter 623 may output the voltage control signal V_VCO by filtering a frequency generated during a loop operation of the recovery 620. In another exemplary embodiment, the charge pump 622 may output a current in proportion to a pulse signal, and the loop filter 623 may change the voltage control signal V_VCO, based on a change in quantity of charges accumulated according to the current by a capacitor. That is, the charge pump 622 and the loop filter 623 may constitute a voltage control circuit for controlling the VCO 624.

The VCO 624 may output a clock signal having a specific frequency in response to the voltage control signal V_VCO.

In an exemplary embodiment, the VCO 624 may be initialized based on a reset signal RESET. That is, the VCO 624 (and the recovery 620) may be switched from a lock state to an unlock state, and re-generate or re-recovery a clock signal corresponding to image data.

The calibrator 630 may select, as an optimum option value, one option value among the option values with respect to the equalizer 610, based on the voltage control signal V_VCO.

In some exemplary embodiments, the calibrator 630 may sequentially provide option values (e.g., eight option values) to the equalizer 610 in a training period, and select an optimum option value among the option values, based on a change rate (or change speed) of a voltage control signal V_VCO corresponding to each of the option values. The training period is a time allocated to generate a clock signal corresponding to a transmission rate of image data in the recovery 620, and may be a time allocated to optimize the equalizer 610.

Although will be described later with reference to FIG. 6, when the change rate of the voltage control signal V_VCO becomes higher, the recovery 620 may more rapidly recover or generate a clock signal corresponding to the transmission rate of the image data DATA1. Also, the recovery 620 may more rapidly switch from the unlock state to the lock state in which the image data DATA1 (or data including a valid grayscale value) may be received and/or recovered. Therefore, the recovery 620 may select an option value corresponding to a voltage control signal V_VCO having the greatest change rate. That is, the calibrator 630 may sequentially provide option values (e.g., eight option values) to the equalizer 610 in the training period, and select one option value among the option values, based on a switching rate at which the recovery 620 is switched from the unlock state to the lock state, corresponding to each of the option values. In an exemplary embodiment, the recovery 620 may select an option value (i.e., an optimum option value) that allows the recovery 620 is most rapidly switched from the unlock state and the lock state, for example.

In an exemplary embodiments, the calibrator 630 may include a differentiator 631, a lock detector 632, an enable signal generator (or delay cell) 633, and a controller 634.

The differentiator 631 may differentiate and output a voltage control signal V_VCO. That is, the differentiator 631 may output a differential value in proportion to a change rate of the voltage control signal V_VCO. The differentiator 631 may be implemented with a general differentiator (e.g., a differential circuit including feedback impedance), and therefore, a description of a detailed configuration of the differentiator 631 will be omitted.

The lock detector 632 may detect a lock state of the recovery 620, based on the compensated image data DATA2 and the clock signal (i.e., the clock signal output from the VCO 624). In an exemplary embodiment, the lock detector 632 may determine whether a frequency of the compensated image data DATA2 corresponds to that of the clock signal, and determine that the recovery 620 in the lock state when the frequency of the compensated image data DATA2 corresponds to that of the clock signal. In another exemplary embodiment, when the frequency of the compensated image data DATA2 does not correspond to that of the clock signal, the lock detector 632 may determine that the recovery 620 is in the unlock state. When the recovery 620 is in the unlock state, a setting operation of the calibrator 630 on the equalizer 610 may be performed.

The enable signal generator 633 may generate an enable signal (or equalizer calibration enable signal) EQ_CAL_EN, based on a power voltage VDD applied to the source drive IC 310. The power voltage VDD may be a power voltage necessary for driving of the source drive IC 310. In an exemplary embodiment, when the power voltage VDD is applied, the enable signal generator 633 may output the enable signal EQ_CAL_EN during a predetermined time, for example. In an exemplary embodiment, the enable signal generator 633 may be implemented with a delay cell, for example. When the enable signal EQ_CAL_EN is output, the setting operation of the calibrator 630 on the equalizer 610 may be performed.

The controller 634 may perform a calibration operation on the equalizer 610 by sequentially outputting option values. Also, the controller 634 may select one option value among the option values by comparing differential values OUTPUT_DIFF (i.e., differential values OUTPUT_DIFF output from the differentiator 631) respectively corresponding to the option values. In an exemplary embodiment, the controller 634 may select, as an optimum option value, an option value corresponding to a differential value OUTPUT_DIFF having the maximum value among the differential values OUTPUT_DIFF, for example. As described above, the option values may be expressed as combinations of the first to third setting values EQ0, EQ1, and EQ2, i.e., signals of three bits, but the invention is not limited thereto.

In some exemplary embodiments, the controller 634 may perform a calibration operation on the equalizer 610, based on a lock detection signal LOCK of the lock detector 632 and the enable signal EQ_CAL_EN generated by the enable signal generator 633. In an exemplary embodiment, the controller 634 may perform the calibration operation on the equalizer 610 only when the recovery 620 is in the unlock state and the enable signal EQ_CAL_EN is provided, for example.

In some exemplary embodiments, the controller 634 may generate a reset signal RESET, based on the lock detection signal LOCK of the lock detector 632, and provide the reset signal RESET to the VCO 624 of the recovery 620. In an exemplary embodiment, the controller 634 may generate and output the reset signal RESET in a pulse form at a time when a certain time elapses after the lock detection signal LOCK of the lock detector 632 is switched from the unlock state to the lock state, for example.

Similarly, the controller 634 may generate a state signal SFC, based on the lock detection signal LOCK of the lock detector 632, and provide the state signal SFC to the outside (e.g., the TCON 410). The state signal SFC may represent a state of the source drive IC 310, e.g., a lock state, an unlock state, a normal state, an abnormal state, etc.

As described with reference to FIG. 4, the receiver 311 of the source drive IC 310 may adaptively derive an optimum option value for optimally driving the equalizer 610 by comparing differential values OUTPUT_DIFF (slopes or change rates) of a voltage control signal V_VCO corresponding to each of the option values.

Figure 5:
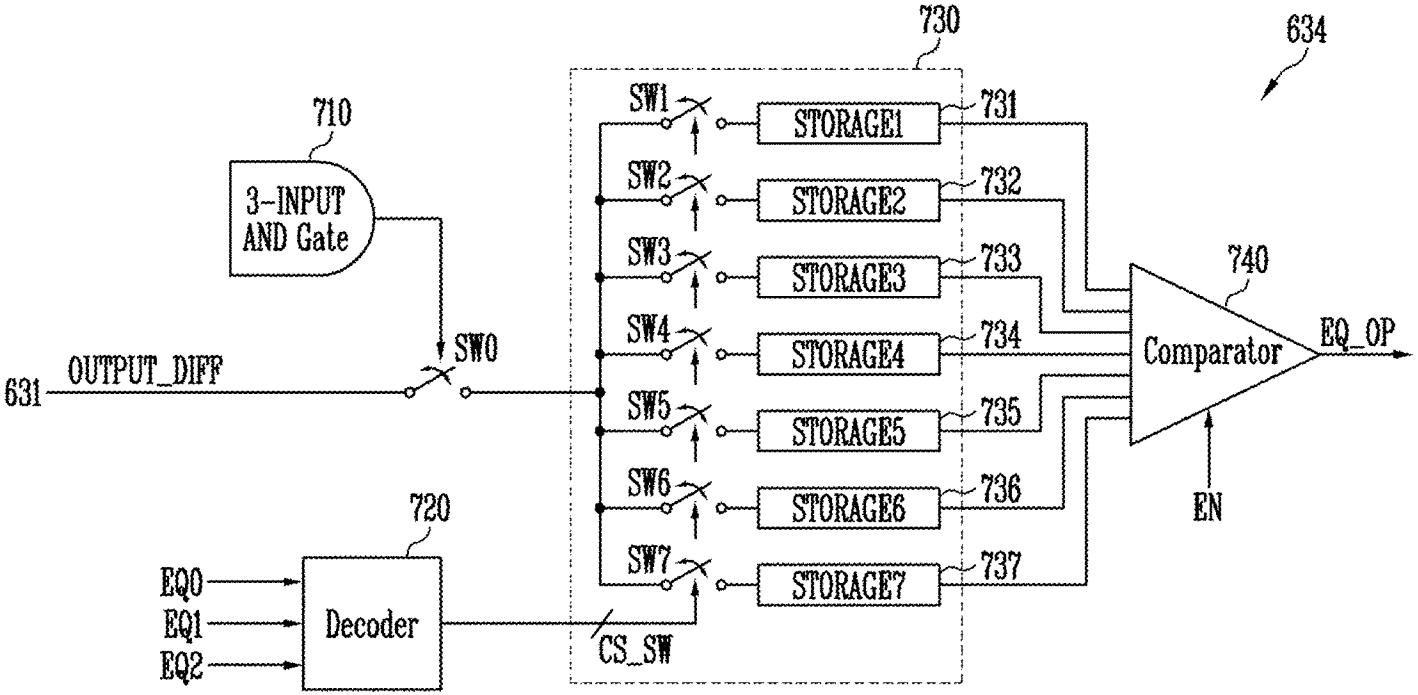
FIG. 5 is a block diagram illustrating an exemplary embodiment of a controller included in the receiver shown in FIG. 4.

FIG. 5 is a block diagram illustrating an exemplary embodiment of the controller included in the receiver shown in FIG. 4.

Referring to FIGS. 4 and 5, the controller 634 may include a reference switch SW0, a first switch control circuit 710, a second switch control circuit 720, a storage circuit 730, and a comparison circuit (or comparator) 740.

The reference switch SW0 may be connected between the differentiator 631 and the storage circuit 730.

The first switch control circuit 710 may control a switching operation of the reference switch SW0, based on an enable signal EQ_CAL_EN, a reset signal RESET, and a lock detection signal LOCK. In an exemplary embodiment, when the first switch control circuit 710 is implemented with a 3-input end AND gate, and the enable signal EQ_CAL_EN of a logic high level, the reset signal RESET of the logic high level, and the lock detection signal LOCK (e.g., a signal representing the unlock state of the recovery 620) of a logic low level are applied, the first switch control circuit 710 may turn on the reference switch SW0, for example. An output signal (i.e., differential values OUTPUT_DIFF) of the differentiator 631 may be provided to the storage circuit 730.

The second switch control circuit 720 may generate a switch control signal CS_SW, based on setting values EQ0, EQ1, and EQ2. The switch control signal CS_SW may be a control signal for selectively turning on one of a plurality of switches SW1 to SW7 provided in the storage circuit 730. In an exemplary embodiment, the second switch control circuit 720 may be implemented with a decoder, and generate switch control signals CS_SW for respectively controlling the switches SW1 to SW7 by the setting values EQ0, EQ1, and EQ2 provided to the equalizer 610 from the controller 634 shown in FIG. 4, for example.

The storage circuit 730 may store differential values OUTPUT_DIFF respectively corresponding to option values.

In some exemplary embodiments, the storage circuit 730 may include sub-storage circuits for respectively storing differential values OUTPUT_DIFF corresponding to option values, and each of the sub-storage circuits may include a switch (or switching element) and a storage element (e.g., a register), which are connected in series between an output terminal of the differentiator 631 and an input terminal of the comparison circuit 740. In an exemplary embodiment, the storage circuit 730 may include first to seventh sub-storage circuits, and the first sub-storage circuit may include a first switch SW1 and a first storage element 731, for example. The first switch SW1 may be turned on in response to a switch control signal CS_SW corresponding to a first option value, and store a first differential value corresponding to the first option value. Similarly, the second sub-storage circuit may include a second switch SW2 and a second storage element 732. The second switch SW2 may be turned on in response to a switch control signal CS_SW corresponding to a second option value, and store a second differential value corresponding to the second option value. That is, a kth (k is a positive integer) sub-storage circuit may include a kth switch SWk and a kth storage element 73*k*. The kth switch SWk may be turned on in response to a switch control signal CS_SW corresponding to a kth option value, and store a kth differential value corresponding to the kth option value.

Although a case where the total size of the setting values EQ0, EQ1, and EQ2 is 3 bits, and the number of sub-storage circuits is seven is illustrated in FIG. 5, this is merely illustrative, and the invention is not limited thereto. In an exemplary embodiment, the total size of the setting values may be 4 bits, and the number of sub-storage circuits corresponding to the total size of the setting values may be 9 or more, for example.

The comparison circuit 740 may output, as an optimum option value EQ_OP, a maximum differential value greatest among the differential values OUTPUT_DIFF stored in the storage circuit 730.

In an exemplary embodiment, the comparison circuit 740 may receive in parallel outputs (i.e., differential values OUTPUT_DIFF) of the storage circuit 730 in response to a control signal EN, and output a maximum differential value greatest among the differential values OUTPUT_DIFF, for example. The control signal EN may be generated by the controller 634, based on the enable signal EQ_CAL_EN described above. In an exemplary embodiment, the control signal EN may have a pulse form at a transition time of the enable signal EQ_CAL_EN, for example.

The controller 634 may provide the optimum option value EQ_OP to the equalizer 610.

Although a case where the controller 634 stores differential values OUTPUT_DIFF respectively corresponding to option values and outputs an optimum option value EQ_OP by comparing the differential values OUTPUT_DIFF is illustrated in FIG. 5, the invention is not limited thereto. In an exemplary embodiment, the controller 634 may repeat update of the optimum option value EQ_OP by comparing differential values sequentially provided through the reference switch SW0 with the optimum option value EQ_OP, and output the optimum option value EQ_OP in response to the control signal EN, for example.

Figure 6:
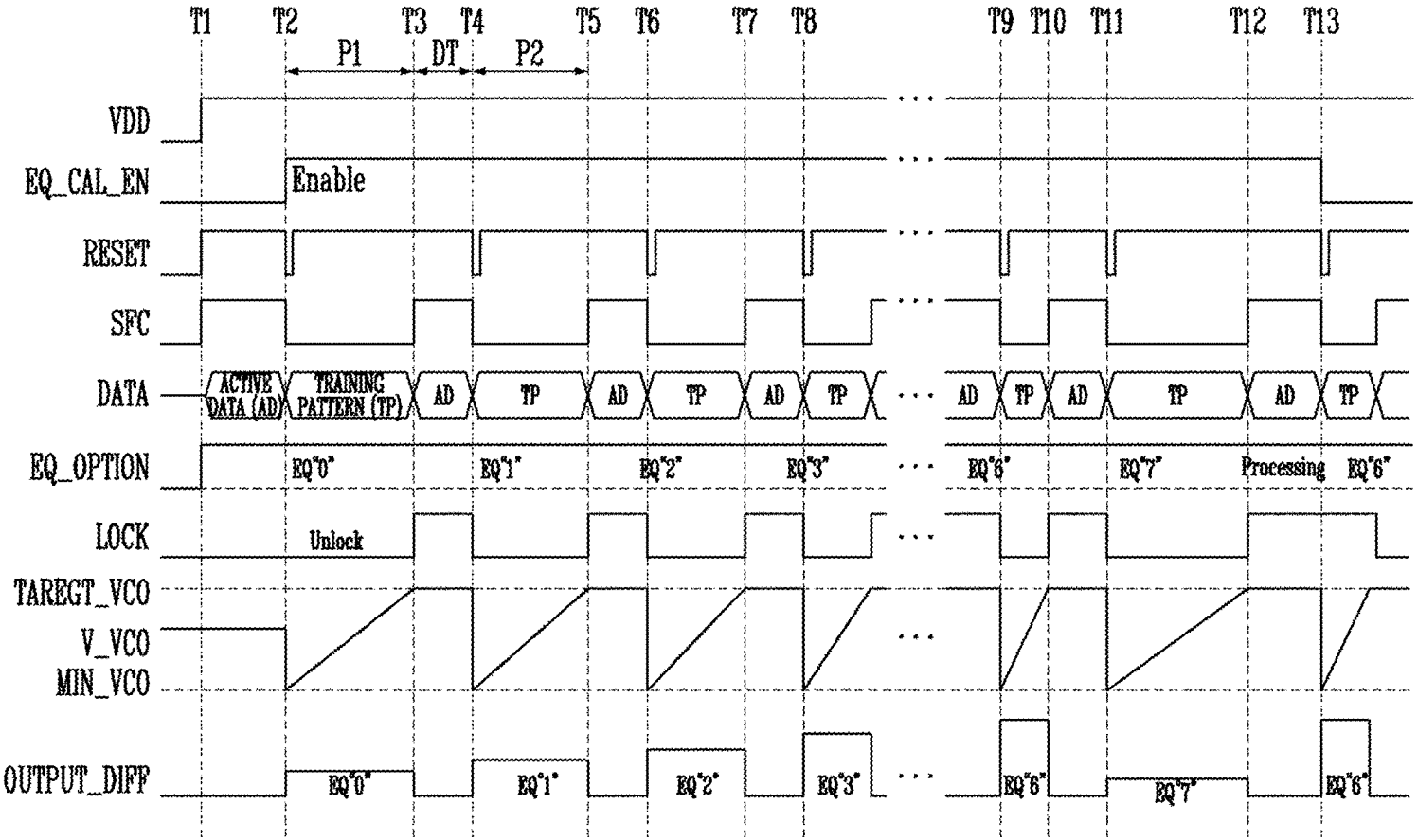
FIG. 6 is a waveform diagram illustrating an exemplary embodiment of signals measured in the receiver shown in FIG. 4.

FIG. 6 is a waveform diagram illustrating an exemplary embodiment of signals measured in the receiver shown in FIG. 4.

Referring to FIGS. 4 to 6, at a first time T1, the power voltage VDD may be changed from the logic low level to the logic high level. When the power voltage VDD of the logic high level is applied (e.g., in power-on of the display device 10), the receiver 311 (and the source drive IC 310) may operate.

At a second time T2, the enable signal EQ_CAL_EN may be changed from the logic low level to the logic high level (or enable state). As described with reference to FIG. 4, the enable signal generator 633 implemented with the delay cell may generate the enable signal EQ_CAL_EN by delaying the power voltage VDD. The enable signal EQ_CAL_EN may be maintained to the logic high level during a specific time (e.g., during a period between the first time T1 and a thirteenth time T13), and the receiver 311 may perform a calibration operation on the equalizer 610 while the enable signal EQ_CAL_EN is being maintained to the logic high level.

The reset signal RESET may have a pulse form of the logic low level, and be set based on the enable signal EQ_CAL_EN and the lock detection signal LOCK. In an exemplary embodiment, the level of the enable signal EQ_CAL_EN is changed, or when the enable signal EQ_CAL_EN has the logic high level, and the lock detection signal LOCK is changed from the logic high level to the logic low level, the reset signal RESET may have a pulse wave of the logic low level, for example. As shown in FIG. 6, the reset signal RESET may have the pulse wave of the logic low level at the second time T2, a fourth time T4, a sixth time T6, an eighth time T8, a ninth time T9, an eleventh time T11, and the thirteenth time T13.

The state signal SFC may be set based on the enable signal EQ_CAL_EN and the lock detection signal LOCK. In an exemplary embodiment, when the enable signal EQ_CAL_EN has the logic low level or when the lock detection signal LOCK is in the lock state, the state signal SFC may have the logic high level, for example.

The image data DATA may include a valid data AD and a clock training pattern TP, corresponding to the state signal SFC. In an exemplary embodiment, when the state signal SFC has the logic high level, the TCON 410 may provide the valid data AD to the source drive IC 310, for example. When the state signal SFC has the logic low level, the TCON 410 may provide the clock training pattern TP to the source drive IC 310. When the clock training pattern TP is provided to the source drive IC 310, the recovery 620 may perform a lock operation.

At the second time T2, an option value EQ_OPTION of the equalizer 610 may have a reference option value EQ"0" among a plurality of option values EQ"0" to EQ"7." That is, at a time when the enable signal EQ_CAL_EN is changed to the logic high level (i.e., a time when a calibration operation on the equalizer 610 is started), the option value EQ_OPTION may have the reference option value EQ"0" according to initialization setting. However, this is merely illustrative, and the invention is not limited thereto.

The equalizer 610 may compensate for distortion of the image data DATA with a frequency gain corresponding to the reference option value EQ"0," and provide the image data DATA to the recovery 620.

The lock detection signal LOCK may represent the unlock state. When the clock training pattern TP is provided, the recovery 620 may perform a generation (or recovery) operation on a clock signal.

The VCO 624 described with reference to FIG. 4 may be reset (or initialized) in response to the reset signal RESET, and generate a clock signal, based on the voltage control signal V_VCO.

When the VCO 624 is reset, the voltage control signal V_VCO provided to the VCO 624 through the phase detector 621, the charge pump 622, and the loop filter 623 may have a minimum control voltage MIN_VCO, and be increased up to a target control voltage TARGET_VCO (i.e., a voltage control signal V_VCO for a clock signal corresponding to the transmission rate of input data DATA) when time elapses.

The differentiator 631 described with reference to FIG. 4 may output a differential value OUTPUT_DIFF representing a change rate (or slope) of the voltage control signal V_VCO by differentiating the voltage control signal V_VCO. In an exemplary embodiment, the differentiator 631 may output a reference differential value corresponding to the reference option value EQ"0," and the reference differential value may be stored in the controller 634 (or the storage circuit 730 described with reference to FIG. 5), for example.

Subsequently, at a third time T3, the voltage control signal V_VCO may reach the target control voltage TARGET_VCO.

The lock detection signal LOCK may represent the lock state, and the state signal SFC may have the logic high level. Accordingly, the valid data AD may be provided to the source drive IC 310.

During a first period P1 between the second time T2 and the third time T3, a reference differential value corresponding to the reference option value EQ"0" may be detected.

At the fourth time T4, the reset signal RESET may be changed to the logic high level. In an exemplary embodiment, when a predetermined reference time DT elapses from the time (e.g., the third time T3) when the lock detection signal LOCK is changed to the lock state, the reset signal RESET may be changed from the logic high level to the logic low level, for example.

Thus, the state signal SFC is changed to the logic low level, the clock training pattern TP is provided to the source drive IC 310, and the lock detection signal LOCK represents the unlock state. Accordingly, the recovery 620 may re-perform the generation (or recovery) operation on the clock signal.

However, at the fourth time T4, the option value EQ_OPTION may have a first option value EQ"1" among the plurality of option values EQ"0" to EQ"7." In an exemplary embodiment, the controller 634 may change the reference option value EQ"0" in a previous period to the first option value EQ"1" in response to the reset signal RESET of the logic low level, for example. Therefore, the equalizer 610 may compensate for distortion of the image data DATA with a frequency gain corresponding to the first option value EQ"1", and provide the image data DATA to the recovery 620. The recovery 620 may perform a generation operation on the clock signal from the image data DATA compensated based on the first option value EQ"1."

The VCO 624 described with reference to FIG. 4 may reset (or initialized) in response to the reset signal RESET, and generate a clock signal, based on the voltage control signal V_VCO. Similarly to the second time T2, at the fourth time T4, the voltage control signal V_VCO may have a minimum control voltage MIN_VCO, and be increased up to a target control voltage TARGET_VCO (i.e., a voltage control signal V_VCO for a clock signal corresponding to the transmission rate of input data DATA) when time elapses.

The differentiator 631 described with reference to FIG. 4 may output a differential value OUTPUT_DIFF representing a change rate (or slope) of the voltage control signal V_VCO by differentiating the voltage control signal V_VCO. In an exemplary embodiment, the differentiator 631 may output a first differential value corresponding to the first option value EQ"1," and the first differential value may be stored in the controller 634 (or the storage circuit 730 described with reference to FIG. 5), for example.

At a fifth time T5, the voltage control signal V_VCO may reach the target control voltage TARGET_VCO. The lock detection signal LOCK represents the lock state, and the state signal SFC has the logic high level. Accordingly, the valid data AD may be provided to the source drive IC 310.

That is, during a second period P2 between the fourth time T4 and the fifth time T5, a first differential value corresponding to the first option value EQ"1 may be detected.

The frequency gain (e.g., a high frequency gain) of the equalizer 610 may be changed depending on an option value of the equalizer 610. Accordingly, the shape of an edge of the image data DATA (or the clock training pattern TP) may be changed, and the time for which a clock signal is generated (or recovered) by detecting and comparing edges may be changed. That is, the second period P2 may have a size different from that of the first period P1. In an exemplary embodiment, the second period P2 may be smaller than the first period P1, for example. When the clock signal is relatively rapidly generated in the second period P2, the voltage control signal V_VCO for generating the clock signal may also be rapidly changed. That is, the change rate (or slope) of the voltage control signal V_VCO may be relatively great, and accordingly, the first differential value may be relatively great. In an exemplary embodiment, a first differential value acquired in the second period P2 may be greater than that acquired in the first period P1, for example.

An operation of the receiver 311 (or the source drive IC 310) in a period between the sixth time T6 and a seventh time T7 may be substantially identical to that of the receiver 311 (or the source drive IC 310) in the period between the fourth time T4 and the fifth time T5, except that the option value EQ_OPTION has a second option value EQ"2," i.e., that the equalizer 610 is set to the second option value EQ"2." Therefore, overlapping descriptions will be omitted.

In the period between the sixth time T6 and the seventh time T7, a second differential value corresponding to the second option value EQ"2" may be detected. That is, the change rate (or slope) of the voltage control signal V_VCO may be relatively great, and accordingly, the second differential value may be relatively great. In an exemplary embodiment, the second differential value may be greater than the first differential value acquired in the second period P2, for example.

An operation of the receiver 311 (or the source drive IC 310) in a period between the eighth time T8 and a tenth time T10 may be substantially identical to that of the receiver 311 (or the source drive IC 310) in the period between the fourth time T4 and the fifth time T5, except that the option value EQ_OPTION has a third option value EQ"3" to a sixth option value EQ"6." Therefore, overlapping descriptions will not be repeated.

In the period between the eighth time T8 to the tenth time T10, a third differential value to a sixth differential value, which correspond to the third option value EQ"3" to the sixth option value EQ"6," may be detected. In an exemplary embodiment, the third differential value may be greater than a second differential value acquired in a previous period, and the sixth differential value may be greater than the third differential value, for example.

An operation of the receiver 311 (or the source drive IC 310) in a period between the eleventh time T11 and a twelfth time T12 may be substantially identical to that of the receiver 311 (or the source drive IC 310) in the period between the fourth time T4 and the fifth time T5, except that the option value EQ_OPTION has a seventh option value EQ"7." Therefore, overlapping descriptions will not be repeated.

In the period between the eleventh time T11 and the twelfth time T12, a seventh differential value corresponding to the seventh option value EQ"7" may be detected. In an exemplary embodiment, the seventh differential value may be smaller than the reference differential value in the first period P1, for example.

Subsequently, in the thirteenth time T13, the enable signal EQ_CAL_EN may be changed from the logic high level to the logic low level (or a disable state). When the enable signal EQ_CAL_EN is changed to the low logic level, the receiver 311 may end the calibration operation on the equalizer 610.

As described with reference to FIG. 5, the controller 634 may set an optimum option value EQ_OP by comparing the reference differential value to the seventh differential value, which are stored in the storage circuit 730. In an exemplary embodiment, the controller 634 may determine the sixth option value EQ"6" as the optimum option value EQ_OP, for example. The equalizer 610 may compensate for distortion of the image data DATA with a frequency gain corresponding to the optimum option value EQ_OP (e.g., the sixth option value EQ"6").

As described with reference to FIG. 6, during a certain time after the power voltage VDD is applied to the source drive IC 310 (i.e., during a time when the enable signal EQ_CAL_EN has the logic high level), differential values (or slopes) of the voltage control signal V_VCO applied to the VCO 624 may be sequentially detected while sequentially changing and setting the option values EQ"0" to EQ"7" of the equalizer 610, and an option value corresponding to a maximum differential value among the differential values may be determined as the optimum option value EQ_OP.

Thus, the source drive IC 310 (and the display device 10) does not require a separate external setting pin, and accordingly, manufacturing cost may be reduced. Further, even when a signal transmission line is changed, the source drive IC 310 may adaptively derive an optimum option value EQ_OP of the equalizer 610.

In the source driver and the display device including the same in accordance with the invention, the equalizer may be automatically set based on a slope (or change rate) of a voltage control signal provided to the VCO for recovering a clock signal. Thus, cost generated by an external setting pin necessary for the equalizer may be reduced.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. A source driver comprising:

a receiver which receives image data, the receiver including:

an equalizer which outputs compensated image data by adjusting a frequency gain of the image data, based on a selected option value among a plurality of option values in a first period;

a recovery which recovers a clock signal corresponding to the compensated image data; and a calibrator which sequentially provides the plurality of option values to the equalizer in a second period prior to the first period, and selects the selected option value among the plurality of option values, based on recovery rates of the clock signal, which respectively correspond to the plurality of option values, and a data signal generator which generates and outputs a data voltage, based on the image data, wherein the recovery includes:

a phase detector which detects a phase difference between the compensated image data and the clock signal, a charge pump and a loop filter which generate a voltage control signal by converting the detected phase difference into a voltage signal; and a voltage control oscillator which outputs the clock signal in response to the voltage control signal, wherein the calibrator compares change rates of the voltage control signal, which respectively correspond to the plurality of option values, and wherein the selected option value corresponds to a greatest change rate among the change rates of the voltage control signal.

2. The source driver of claim 1, wherein the calibrator includes:

a differentiator which outputs a differential value by differentiating the voltage control signal; and a controller which selects the selected option value among the plurality of option values, based on the differential value.

3. The source driver of claim 2, wherein the controller includes:

a storage circuit which stores differential values respectively corresponding to the plurality of option values; and a comparison circuit which outputs a maximum differential value greatest among the differential values by comparing the differential values.

4. The source driver of claim 3, wherein the storage circuit includes sub-storage circuits which respectively store the differential values, wherein each of the sub-storage circuits includes a switching element and a storage element, which are connected in series between an output terminal of the differentiator and an input terminal of the comparison circuit, and wherein the switching element is turned on in response to a corresponding option value.

5. The source driver of claim 2, wherein the calibrator further includes a lock detector which determines whether a frequency of the compensated image data corresponds to that of the clock signal, and wherein the controller operates based on an output signal of the lock detector.

6. The source driver of claim 5, wherein the calibrator further includes an enable signal generator which generates an enable signal during a predetermined period, based on a power voltage applied from an outside, and wherein the enable signal is applied to the controller in the second period.

7. The source driver of claim 5, wherein the controller generates a reset signal in a pulse form at a time when a reference time elapses from a time when the output signal of the lock detector is changed from a logic low level to a logic high level, and wherein the voltage control oscillator is reset based on the reset signal.

8. The source driver of claim 7, wherein, when the voltage control oscillator is reset, the voltage control signal has a minimum control voltage, and wherein the voltage control signal is linearly changed up to a target control voltage according to an operation of the voltage control oscillator.

9. A display device comprising:

a timing controller which generates image data;

a data driver which generates a data voltage, based on the image data, the data driver including:

an equalizer which receives the image data, and which outputs compensated image data by adjusting a frequency gain of the image data, based on a selected option value among a plurality of option values in a first period;

a recovery which recovers a clock signal corresponding to the compensated image data; and a calibrator which sequentially provides the plurality of option values to the equalizer in a second period prior to the first period, and which selects the selected option value among the plurality of option values, based on recovery rates of the clock signal, which respectively correspond to the plurality of option values, and a display unit including a pixel which receives the data voltage through a data line and emits light with a luminance corresponding to the data voltage, wherein the recovery includes:

a phase detector which detects a phase difference between the compensated image data and the clock signal, a charge pump and a loop filter which generate a voltage control signal by converting the detected phase difference into a voltage signal; and a voltage control oscillator which outputs the clock signal in response to the voltage control signal, wherein the calibrator compares change rates of the voltage control signal, which respectively correspond to the plurality of option values, and wherein the selected option value corresponds to a greatest change rate among the change rates of the voltage control signal.

10. The display device of claim 9, wherein the calibrator includes:

a differentiator which outputs a differential value by differentiating the voltage control signal; and a controller which selects an option value among the plurality of option values, based on the differential value.

11. The display device of claim 10, wherein the controller includes:

a storage circuit which stores differential values respectively corresponding to the plurality of option values; and a comparison circuit which outputs a maximum differential value greatest among the differential values by comparing the differential values.

12. The display device of claim 11, wherein the calibrator further includes a lock detector which determines whether a frequency of the compensated image data corresponds to that of the clock signal, wherein the controller operates based on an output signal of the lock detector.

13. The display device of claim 12, wherein the controller generates a reset signal in a pulse form at a time when a reference time elapses from a time when the output signal of the lock detector is changed from a logic low level to a logic high level, wherein the voltage control oscillator is reset based on the reset signal.

* * * * *